United States Patent [19]

Holzer

[11] Patent Number: 5,040,378

[45] Date of Patent: Aug. 20, 1991

[54] NO FROST COOLING PROCESS FOR A COOLING RANGE ABOVE ZERO DEGREES CELSIUS

[76] Inventor: Walter Holzer, Drosteweg 19, D-7758 Meersburg, Fed. Rep. of Germany

[21] Appl. No.: 457,809

[22] PCT Filed: Apr. 27, 1989

[86] PCT No.: PCT/EP89/00464

§ 371 Date: Dec. 22, 1989

§ 102(e) Date: Dec. 22, 1989

[87] PCT Pub. No.: WO89/10523

PCT Pub. Date: Nov. 2, 1989

[30] Foreign Application Priority Data

Apr. 27, 1988 [DE] Fed. Rep. of Germany ..... 3814238

[51] Int. Cl.[5] ..... F25D 17/04; F25D 21/04

[52] U.S. Cl. ..... 62/186; 62/187; 62/179; 62/409; 62/411

[58] Field of Search ..... 62/177, 178, 179, 186, 62/187, 439, 454, 455, 456, 274, 409, 410, 411, 412

[56] References Cited

U.S. PATENT DOCUMENTS

| | | | |
|---|---|---|---|
| 1,897,205 | 8/1931 | MacCabee | 62/411 |
| 1,900,580 | 2/1931 | Moore | 62/288 |
| 1,980,109 | 11/1934 | Stockly | 62/178 X |
| 2,042,384 | 8/1935 | Bird et al. | 62/186 X |
| 2,048,137 | 7/1936 | Palmer | 62/186 X |
| 2,049,708 | 8/1936 | Lieb | 62/439 X |
| 2,053,453 | 9/1932 | Wendler | 98/51 |
| 2,059,016 | 6/1935 | Newman | 62/411 |
| 2,090,413 | 4/1936 | Gould | 62/150 |
| 2,143,188 | 12/1935 | Coulter | 62/62 |
| 2,161,421 | 6/1939 | Kucher | 62/409 X |
| 2,224,878 | 12/1940 | Morrison | 62/411 X |
| 2,250,386 | 7/1941 | Maniscalco | 62/439 X |
| 2,626,509 | 3/1950 | Morrison | 62/279 |
| 2,801,526 | 8/1957 | Solley, Jr. | 62/6 |
| 3,070,973 | 1/1963 | O'Connell | 62/180 |
| 4,422,305 | 12/1983 | Grosskopf | 62/430 |
| 4,676,073 | 6/1987 | Lawrence | 62/180 |

FOREIGN PATENT DOCUMENTS

| | | |
|---|---|---|
| 1120476 | 12/1961 | Fed. Rep. of Germany . |
| 2454068 | 11/1980 | France . |

*Primary Examiner*—Harry B. Tanner

*Attorney, Agent, or Firm*—Brown, Martin, Haller & McClain

[57] ABSTRACT

According to this invention, cold is conveyed into a cooling chamber by means of convectors, and fresh air of a higher temperature is supplied in a controlled manner so that the temperature decreases. To avoid power loss due to the quantity of heat supplied, the displaced cold air is channeled towards a heat exchanger in the condenser of the cooling machine. Since the fresh air which circulates is always above 0° C., the humidity content of the fresh air supplied can be controlled and be filtered to remove odors.

7 Claims, 1 Drawing Sheet

NO FROST COOLING PROCESS FOR A COOLING RANGE ABOVE ZERO DEGREES CELSIUS

During the last years Nofrost refrigerators have entered the market very successfully, since they offer the important advantage of avoiding ice formation in the cooling chamber and, thus, the troublesome defrosting of the ice built-up.

The process is essentially based on the idea that—in a separate section of the refrigerator—air is supercooled at the evaporator of the cooling machine and that this supercooled air is transferred into the actual cooling chamber by a blower until the required mixed temperature is reached and the blower is turned off by a thermostat. The humidity of the exchanged air condenses on the evaporator of the cooling machine, and the usual ice builtup occurs on the evaporator. However, this process does not extend to the actual cooling chamber. The evaporator is defrosted in certain intervals by increasing the temperature, and the melted ice is drained without problem.

Because of the advantages mentioned—no icing and no defrosting—this process has conquered the market in no time.

The main disadvantage of the process is the dehumidification of the air during supercooling and, thus, the extreme low humidity level within the cooling chamber, causing the food in such refrigerators to quickly dry out and lose taste and shelf life, unless the food is packaged airtight.

Subject of the invention is to offer a process which avoids this important disadvantage without losing the advantages of the nofrost process.

The solution to the problem is a system, in which the cold reaches the cooling chamber by means of convectors instead of cold air, and the required temperature is obtained by a controlled supply of fresh air of higher temperature to the cooling chamber. The assumption is that the quantity of cold air reaching the cooling chamber during a certain time period is smaller than the amount of heat which enters during maximum fresh air supply. Otherwise, the temperature would keep decreasing due to the preponderant presence of cold air, possibly below 0° C. with all the icing consequences.

The fresh air supply ensures that the cooling chamber does not get too cold and that the temperature remains in the predetermined range.

The inflow of fresh air is naturally cooled by the convectors, resulting in a loss of cold following its exit from the cooling chamber; thus, it is proposed as per the invention, to lead the cooled exhaust air to a heat exchanger which, for instance, could be assigned to the warm condenser of the cooling machine, so that the cold is again led into the cycle of the cooling machine.

This effect can even be increased by leading the exhaust air, which has been heated in the heat exchanger, within a closed cycle to the cooling chamber as fresh air. The designation fresh air, in this connection, is to be understood as air which is again led into the cooling chamber, whereby a pre-treatment as per the invention is recommended. This pre-treatment can, for instance, consist of warming as described above, or even of cooling. Furthermore, filtering, for instance by using an activated charcoal filter, is appropriate to avoid the effect of odors, in case cigarette smoke or cooking vapors from the kitchen could be absorbed.

A refrigerator as per the invention, thus, requires at least one air inlet duct and one air exhaust duct between the cooling chamber and the fresh air, whereby a blower with temperature control monitors the air exchange. It is of no importance whether the blower is located in the air inlet duct or in the exhaust duct.

When the refrigerator door is opened, warmer ambient air normally enters and it takes some time until the higher temperature is again decreased to the required cooling range. Thus, it is recommended as per the invention to supply an additional air inlet duct for cold air; another blower with temperature control ensures that in such a case cold air instead of fresh air enters the cooling chamber. The temperature control turns the cold air supply off either once the cooling range is reached or close to that range, and the fresh air control starts to function again.

Instead of a second blower a reversing valve could obviously be provided, in order to switch from fresh air to cold air when required.

In order to fulfill the premise that the cold supplied from the convectors is always less than the heat getting into the cooling chamber during maximum fresh air supply, the arrangement as per the invention is that the convector surfaces facing the cooling chamber are designed for excellent heat conduction, in order to quickly reduce the temperature of the air flow, however, beneath the surface less conductive layers are provided to reduce the cold transfer through the walls of the convectors.

Good cold transfer from the surfaces of the convectors to the fresh air is achieved by providing cooling ribs or other surface-enlarging shapes. Furthermore, shaping at least part of the cooling chamber walls as convectors adds to increased effectiveness and lowers the design costs.

As per the invention it is also proposed to design the convectors as cold storage, whereby the design of the convectors as latent cold storage is very simple. Particularly in a temperature range above 0° C. the use of water or a water mixture with small amounts of additives lowering the freezing point is possible and cost-advantageous.

Another design feature to conserve sensitive foods without damaging them and without entering the freezing temperature range is an inner food container within the cooling chamber and the arrangement of the air inlet ducts in such a manner that the fresh air—or at least part of it—flows into the area between the inner wall of the cooling chamber and the inner container. Thus, local undercooling is avoided.

In order to retrofit existing refrigerators for the new process it is suggested as per the invention to design the cooling chamber as an independent chassis-type unit, whereby the walls are serving as cold transfer, through which the cold from the freezer get into the cooling chamber.

In such a case it is recommended to install the additionally required components, such as blower and thermostat, in the chassis, i.e. in the area of the controlled temperature above 0° C. In such a version the fresh air duct as well as the exhaust duct can be designed as flat hoses, which can easily be led through the door fitting from the freezer to the outside.

In order to adapt the device as per the invention to individual requirements and seasonal differences, it is furthermore proposed, to provide a manually adjustable throttle valve in the area of the fresh air duct and/or the exhaust duct. For the same purpose a manually adjustable throttle valve is provided which varies the cold supply in the area of the convectors.

BRIEF DESCRIPTION OF THE DRAWINGS

FIG. 1 is a schematic of a freezer (25) as per the invention with a cooling chamber (1) in its upper part. A low-temperature compartment (34) also containing the evaporator (27) of the cooling machine (5) is located underneath. The cooling chamber (1) and the low-temperature compartment (34) are separated by a separating wall (16) which essentially determines the cold flow into the cooling chamber (1). After passing through the throttled passage and the separating wall (16) the cold reaches the convector (2) consisting of heat-conductive material, for instance, aluminum. In order to increase the effectiveness of this convector, it is designed with extensions (26) which are extending up the sidewalls. The ribs (17) also increase the effectiveness.

Figure 2:
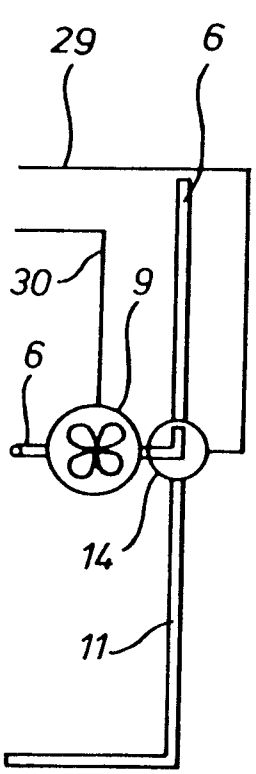
FIG. 2 is similar to a portion of FIG. 1, showing a single blower arrangement.

Due to the cold flow the convector (2) now cools off, however, as soon as a certain temperature, for instance +2° C. is reached, the temperature control (10) turns the blower (9) on, and fresh air reaches the cooling chamber (1) through the fresh air duct (6). The convector (2) is warmed up and held at 2° C. However, as soon as the temperature exceeds 2° C., the temperature control (10) turns the blower (9) off, and again the cooling chamber (1) is under the influence of only the cooling convector (2).

During the fresh air flow through the fresh air duct (6) air is being displaced in the cooling chamber and reaches the outside through exhaust duct (7). To avoid a cold loss, the exhaust passes a heat exchanger (3), which is cooling the condenser (4) of cooling machine (5). Thus the cold is returned to the prime cold cycle and only a small part is lost. The prime cold cycle, consisting of cooling machine (5), condenser (4), a throttle valve (8) and the evaporator (27) is supplied with cold by the cooling of the condenser. The heat exchanger (3) can, of course, also be located separate from the condenser (4), as it usually the case in cooling equipment.

A further improvement is obtained by connecting the exhaust duct (7) via the connection piece (23) with the fresh air duct (6), thus creating a closed cycle.

Figure 1:
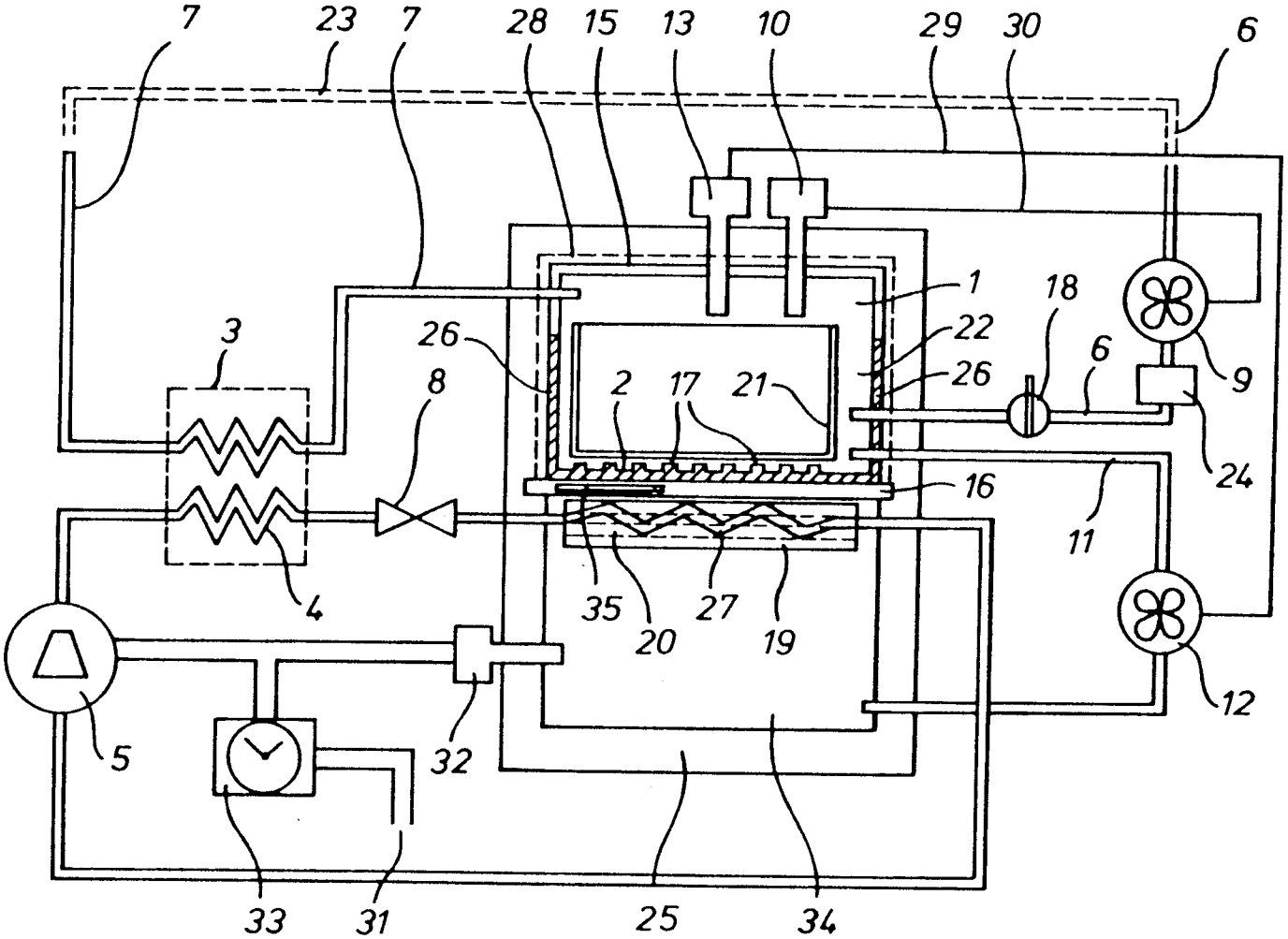
FIG. 1 is a schematic of the freezer system.

FIG. 1 also shows the schematic of a suitable design of the evaporator (27) in combination with a cold storage (19), whereby a latent cold storage filled with liquid (20) can be used for the respective temperature values.

Since the temperature inside the refrigerator rises considerably during opening and filling of the refrigerator with fresh food, a cooling down to the required temperature range may be very slow under the given circumstances, due to the throttled cold flow through plate (16). To achieve more rapid cooling a connection is provided from cooling chamber (1) via the cold air duct (11) and the second blower (12) to the deep freezer (34). As soon as the temperature in the cooling chamber (1), upon opening of the door, exceeds +4° C. the temperature control (13) starts the blower (12), and additional cold air from the freezer (34) moves into the cooling chamber (1) until the temperature control (13) turns the blower (12) off, when +4° C. is reached. Then the temperature control (10) with blower (9) take over, i.e. blower (9) starts only when the temperature within the cooling chamber (1) falls below +2° C.

FIG. 2 shows how one single blower (9) can be used instead of the two blowers (9) and (12) by providing a valve (14) which connects either the fresh air duct (6) or the cold air duct (11) with the blower (9).

FIG. 2 shows further details of the invention.

Since the arrangement of latent cold storage devices can easily collect larger cold quantities, it is recommended to equip such a freezer with a timing device (clock) (33), in order to connect the cooling machine (5), which is operated as usual via a thermostat (32) of the freezer (34), to a utility power connection (31) only, for instance, during night hours, when inexpensive energy is available. Thus, not only the operating expenses can be reduced, but power supply problems can be avoided.

Since fresh air cooling as per the invention using humid air and precise temperature control just above 0° C. greatly improve the taste as well as shelf life of the food, a solution is proposed, which makes it possible to retrofit existing freezers with such cooling chambers. All cold transfer components are combined in a chassis-type unit (28). It is preferred that such chassis (28) also include the blower (9) and the temperature control (10), possibly even filters or moistening devices (24).

FIG. 1 also contains a schematic of a throttle valve 35, which is used to vary the cold transfer through plate (16) for the purpose of increasing the flow of cold, for instance during summer or in warmer climates.

A similar purpose is fulfilled by throttle valve (36) which influences the air flow accordingly.

The examples in FIG. 1 and 2 show the multitude of possible variants for refrigerators with fresh air cooling in accordance with the invention. All other known measures may, of course, be combined with this system in order to achieve adaptation of other design concepts. In this sense, the schematics shown are to be considered non-restrictive examples only.

I claim:

1. A no-frost refrigerator, comprising:

an outer refrigerator housing;

an independent cooling compartment mounted within the outer housing to form a separate cooling chamber;

a separate inner container for containing goods to be cooled mounted within the cooling compartment;

a freezer compartment containing an evaporator mounted within the outer housing adjacent one end of said cooling compartment and separated from the cooling compartment by a dividing wall, the evaporator being located immediately adjacent the dividing wall;

the cooling compartment having an air inlet duct and an exhaust duct for ambient air flow through the cooling chamber;

a blower for circulating air through the cooling compartment via the inlet and exhaust ducts;

temperature control means for controlling operation of the blower to control temperature in the chamber in conjunction with the evaporator;

the cooling compartment walls facing the cooling chamber having higher heat conductivity than the dividing wall; and inner surfaces of the cooling compartment walls beneath the inner container having cooling ribs on which the inner container is seated.

2. The refrigerator as claimed in claim 1, including connecting passageways defining a first cooling agent circulation path including the evaporator, a compressor, a condenser and an expansion valve, a heat exchanger for cooling the condenser connected via a second circulation path to the exhaust duct on one side and the air inlet duct on the other side, the air inlet duct comprising means for directing airflow into a space between the inner surface of the cooling compartment walls and the outer surface of the inner container walls, the walls of the cooling compartment having a higher coefficient of heat conductivity than the dividing wall.

3. The refrigerator as claimed in claim 1, including a passageway connecting the cooling chamber with the freezer compartment, a second blower located in said passageway, and second temperature control means for controlling the second blower to direct cold air from the freezer compartment to the cooling chamber when the temperature in the cooling chamber is above a predetermined limit.

4. The refrigerator as claimed in claim 1, including a reversing valve in the inlet duct upstream of the blower, and a passageway connecting the cooling chamber with the freezer compartment, the reversing valve comprising means for selectively connecting the cooling chamber with the exhaust duct or with the freezer compartment, and temperature control means for controlling the reversing valve to connect the cooling chamber with the freezer compartment when the temperature in the cooling chamber is above a predetermined value.

5. The refrigerator as claimed in claim 1, wherein the cooling chamber comprises a latent cold reservoir, and the air inlet duct includes means for pre-treating incoming air, the pre-treatment means being selected from a group consisting of cooling means, filtering means, moistening means, and preservative adding means.

6. The refrigerator as claimed in claim 3, in which the cooling chamber comprises a removable insert unit inserted into the refrigerator outer housing, the air inlet and exhaust ducts being passed through the door fittings of the refrigerator to the outside, and the second blower and temperature control means are located within the insert unit in an area having a temperature which remains above 0° C.

7. The refrigerator as claimed in claim 1, including a manually adjustable throttle valve located in one of the air inlet and exhaust ducts for controlling the air flow.

* * * * *